US005724754A

United States Patent [19]

Kataoka et al.

[11] Patent Number: 5,724,754

[45] Date of Patent: Mar. 10, 1998

[54] HARD PLATE FOR SPIKED TRACK SHOES

[75] Inventors: Akira Kataoka, Kobe; Masanobu Inohara, Akashi; Rvuichi Tsukita; Toshio Suma, both of Kobe; Kiyohiro Saito, Akashi, all of Japan

[73] Assignee: Asics Corporation, Japan

[21] Appl. No.: 707,373

[22] Filed: Sep. 4, 1996

Related U.S. Application Data

[62] Division of Ser. No. 465,752, Jun. 6, 1995, Pat. No. 5,581,913, which is a division of Ser. No. 361,477, Dec. 22, 1994, Pat. No. 5,483,760, which is a continuation of Ser. No. 68,128, May 27, 1993, abandoned, which is a continuation-in-part of Ser. No. 58,065, May 5, 1993, abandoned.

[30] Foreign Application Priority Data

| | | | |
|---|---|---|---|
| May 13, 1992 | [JP] | Japan | 4-146297 |
| Apr. 23, 1993 | [JP] | Japan | 5-97704 |
| May 13, 1993 | [JP] | Japan | 5-111927 |

[51] Int. Cl.[6] ..... A43B 5/00; A43C 15/00

[52] U.S. Cl. ..... 36/134; 36/129; 36/59 R; 36/59 C; 36/67 R; D2/959

[58] Field of Search ..... 36/129, 134, 59 R, 36/59 C, 7.6, 126, 67 R, 67 D; D2/951, 959, 962

[56] References Cited

U.S. PATENT DOCUMENTS

| | | | |
|---|---|---|---|
| D. 327,975 | 7/1992 | Saito et al. . | |
| D. 331,487 | 12/1992 | Arai . | |
| 921,452 | 5/1909 | Pierce | 36/59 C |
| 1,333,409 | 3/1920 | Golden . | |
| 1,559,450 | 10/1925 | Oakley | 36/59 C |
| 1,581,861 | 4/1926 | Oberdorfer | 36/59 C |
| 3,577,663 | 5/1971 | Mershon . | |
| 3,662,478 | 5/1972 | Schwab | 36/59 C |
| 3,849,915 | 11/1974 | Inohara | 36/59 C |
| 3,918,181 | 11/1975 | Inohara | 36/129 |
| 4,173,083 | 11/1979 | Infusino . | |
| 4,327,503 | 5/1982 | Johnson . | |
| 4,641,438 | 2/1987 | Laird et al. . | |
| 4,642,917 | 2/1987 | Ungar | 36/59 C |
| 5,483,760 | 1/1996 | Kotaoka et al. | 36/59 R |

FOREIGN PATENT DOCUMENTS

| | | |
|---|---|---|
| 2 385 349 | 10/1978 | France . |
| 30 25 928 A1 | 2/1982 | Germany . |

*Primary Examiner*—M. D. Patterson

*Attorney, Agent, or Firm*—Nixon & Vanderhye P.C.

[57] ABSTRACT

A hard plate of spike shoes for track races comprises a plurality of small projections or small holes on an anterior forefoot portion in at least half the forefoot portion, and a plurality of large projections greater than said small projections or small holes on a posterior forefoot portion.

16 Claims, 19 Drawing Sheets

HARD PLATE FOR SPIKED TRACK SHOES

CROSS REFERENCE TO RELATED APPLICATION

This application is a divisional of application Ser. No. 08/465,752, filed Jun. 6, 1995 (now U.S. Pat. No. 5,581,913, which in turn is a divisional of application Ser. No. 08/361,477 filed Dec. 22, 1994 (now U.S. Pat. No. 5,483,760), which is a continuation of Ser. No. 08/068,128 filed May 27, 1993 (abandoned), which is a continuation-in-part of application Ser. No. 08/058,065 filed May 5, 1993 (abandoned).

BACKGROUND OF THE INVENTION

1. Field of the Invention

The present invention relates to a hard plate of spike shoes for short distance track races principally in an all-weather type track.

2. Description of the Related Art

Conventional spike shoes for short distance track races are provided with a number of projections on a surface of a hard plate thereof, in addition to several spikes. These projections do not differ distinctly from each other in shape, and they do not take respective definite roles. That is, in order to obtain a better gripping property with a running track, an appropriately shaped projections are merely arranged in a space on the hard plate onto which no spike is mounted.

It is not certain whether these conventionally shaped and dimensioned projections grip efficiently pavement materials of a track. Further, since these conventional projections are arranged so as to surround a root of each of all spikes, some configurations of arrangements of the projections prevent the spikes from sufficiently penetrating into the pavement materials of the track, thus causing attenuation of the gripping property of the spike shoes.

Furthermore, the conventional projections are distributed almost homogeneously in the hard plate. With such an arrangement, runner's running can not be improved.

SUMMARY OF THE INVENTION

It is therefore an object of the present invention to provide a hard plate of spike shoes for track races, which can make efficiently the most use of the power of the runner.

The above-mentioned object of the present invention can be achieved by a hard plate of spike shoes for track races, having a plurality of small projections or small holes on an anterior forefoot portion in at least about half the forefoot portion, and a plurality of large projections greater than the small projections or small holes, on a posterior forefoot portion.

The hard plate of spike shoes for track races according to the present invention makes efficiently the most use of the runner's power, because it has a plurality of small projections or small holes on the anterior forefoot portion in at least about half the forefoot portion, and a plurality of large projections greater than the small ones, on the posterior forefoot portion.

Further objects and advantages of the present invention will be apparent from the following description of the preferred embodiments of the invention as illustrated in the accompanying drawings.

DESCRIPTION OF THE PREFERRED EMBODIMENTS

FIGS. 1 to 4 each shows a hard plate 2 of spike shoes for track races, onto which a plurality of spikes 1 are fixed.

Figure 1:
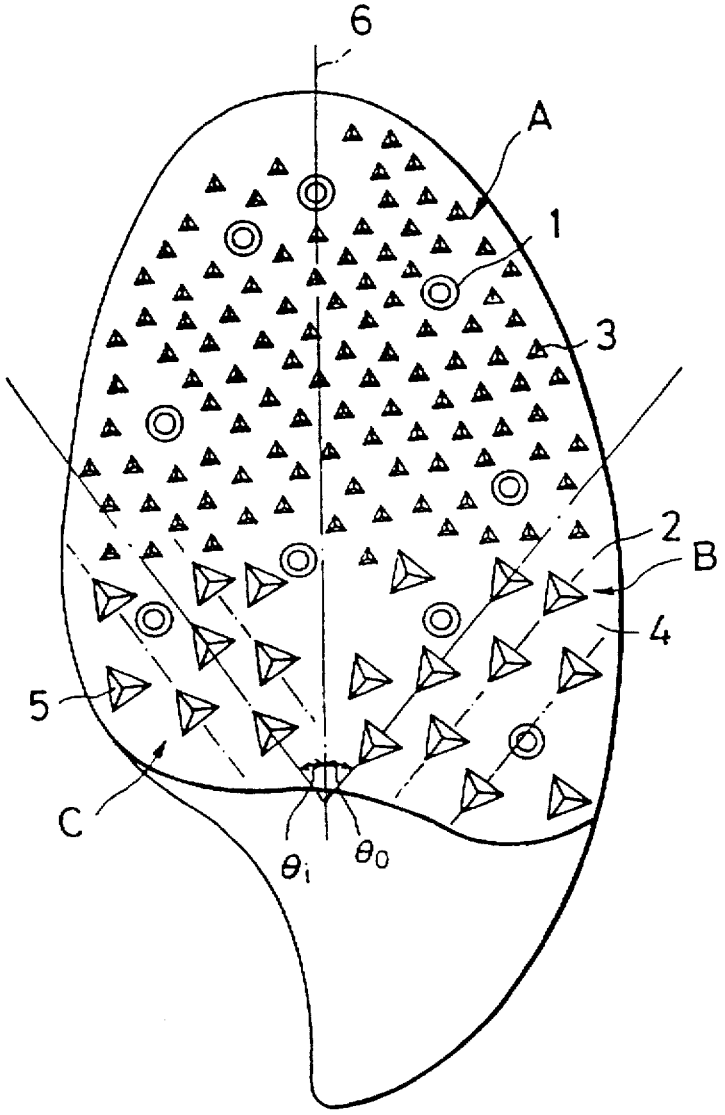
FIG. 1 is a plan view of a first embodiment of the present invention.

As a result of analyses on a magnitude, a direction, and a position of a force, as well as movements of a foot on contact with a ground during a running action, it was found out that the hard plate can be divided into three regions depending on its principal role, that is, a propulsion region (A), a braking region (B) and a balance and acceleration region (C) (Refer to FIG. 1).

The propulsion region (A) is a part situated on an anterior forefoot portion and including a part just under a dactylopodite portion. This is a region where a rearward slip should be suppressed at its maximum.

A test showed that the spike 1 demonstrates a better gripping property when it penetrates into the ground deeply up to its root. Therefore, it is better for this region not to be provided with projections so large as to prevent the penetration of the spike. However, this does not mean that the projections are not needed at all. In the preferred embodiment, onto the hard plate are mounted projections 3 each of which is so shaped as to demonstrate a maximum gripping force when the surface of the hard plate comes into contact with a ground. A shape of each of the projections 3 is exemplified by a hard fine particle like a sand paper, a projection on a grater and a fine thorn which is dispersed in an infinite number on a plate. In case of the shape like the projection on the grater, the projections are arranged so as to demonstrate a maximum gripping property with respect to a direction in parallel with a center line 6 of a shoe.

Further, as an example of substitutions for the projections 3, a number of holes or of grooves provided on the hard plate 2, or a number of combinations of a hole with a groove provided on the hard plate 2 can be considered.

The braking region (B) is a part situated on an outer posterior forefoot portion in about half the forefoot portion. This region is mainly used during about 30 msec immediately after a landing. This region is required therefore to buff a landing impact, grip the ground speedily, and has the gripping property enough to assist in a smooth movement of an upper part of a body. With respect to the landing impact and to the speedy gripping with the ground, the test showed that when comparing a plane hard plate with a hard plate provided with large projections, an impact buffering effect is larger and a time for reaching a peak value of the landing impact is slightly shorter in the latter. Further, taking consideration into the fact that a significantly large vertical load is imparted onto the breaking region in comparison with the other regions, it is therefore preferable that relatively large projections 4 are attached onto this region. As an example of the shape of each of the projections 4, a cone, a pyramid, a laterally placed triangular prism can be considered. In the case of the circular cone, the triangular prism, etc., each of which produces a directive property, the projections 4 are oriented outwardly from the center line 6 of the shoe at an angle ($\theta_0$) of from about 5° to 45°, preferably from 10° to 20°, and most preferably 14°. Then, with respect to the assistance in the movement of the upper part of the body, it means that the breaking region has the gripping property to such an extent that the runner does not feel "slipped" at a landing moment. This gripping property of the breaking region (B) is not so sever as required in the propulsion region (A), and it has a tolerance of the slip upto about 4 mm. This is because according to a search report, the runner is insensible of the slip of up to 4 mm. and that the slip contributes slightly an extension of a stride, since the slip in this case is oriented forwardly.

The balance and acceleration region (C) is a part situated on an inner posterior forefoot portion in about half the forefoot portion. This region takes a role in maintaining right and left balances on contact with the ground, and in demonstrating a propulsion force at a start dash moment. Therefore, projections 5 are needed to such an extent that the runner does not fail to balance by an inclined shoe (foot) due to the projections 4 arranged on the braking region (B). The projections 5 are required to be shaped so as to suppress a rearward slip at its maximum. Even if relatively large projections are arranged around a thenar in the balance and acceleration region, a serious problem on the gripping property is not caused since a large vertical load is imparted thereto. Also, it is preferable that large projections are arranged in this region in consideration of a balance with the braking region (B). A shape of each of the projections 5 may be identical to that of each of the projections 4 in the braking region (B). Furthermore, when the projections each having a directive property in this region are used, they are oriented inwardly from the center line 6 of the shoe at an angle ($\theta_1$) from about 5° to 46°, preferably 10° to 20°, and most preferably 14°.

A material of the projections 3, 4, and 5 is the same as that of the hard plate 2. The projections 3, 4, and 5 are integrally mounted on the hard plate 2.

As the material of the hard plate 2 and of the projections 3, 4, and 5, there are thermoplastic resin and thermometer resin such as polyamide, polyamide elastomers, urethane, nylon 6, 11 and 12. At least one of glass fiber, carbon fiber, and aramid fiber may be mixed with these materials.

Figure 2:
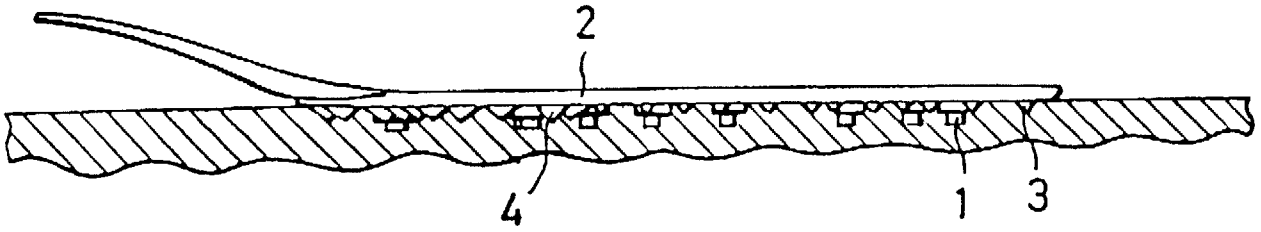
FIG. 2 is a side view of a hard plate of FIG. 1.

The present invention will be explained in detail on the basis of the first embodiment shown in FIGS. 1 and 2, as below.

A plurality of small projections 3 are arranged on the anterior forefoot portion in about half the forefoot portion. Each of the small projections 3 is a triangular pyramid. One of side faces of each of the small projections 3 is orthogonal with the center line 6 of the shoe and faces rearward. A ridge line opposite to the one of the side faces is oriented forwardly. This region constitutes the propulsion region (A).

In the most preferable embodiment of the projections 3, a rear side face is preferably vertical to a bottom of the hard plate 2, and a height of each of the projections 3 is between 2 and 6 mm, preferably between 4 and 5 mm, a longitudinal length of a bottom face of each of the projections is between 2 and 7 mm, preferably between 3 and 5 mm, and a lateral length of the bottom face thereof is between 2 and 7 mm, preferably between 3 and 5 mm.

A plurality of triangle pyramid-like large projections 4 greater than the small projections 3 are arranged on an outer posterior forefoot portion in about half the forefoot portion. This portion constitutes a braking region (B). On an inner posterior forefoot portion are arranged large projections 5 each having approximately the same dimension as that of each of the large projections 4. This region constitutes the balance and acceleration region (C).

The projections 4 are aligned outwardly from the center line 6 of the shoe alone a first inclined direction at a first predetermined angle ($\theta_0$). One of the side faces of each of the projections 4 is orthogonal with the first inclined direction, and a ridge line opposite to the one of the side faces is oriented substantially rearward in the inclined direction. The projections 5 are aligned inwardly from the 3center line 6 of the shoe along a second inclined direction at a second predetermined angle ($\theta_1$). One of side faces of each of the projections 5 is orthogonal with the second inclined direction, and one ridge line opposite to the one of the side faces is oriented forwardly in the second inclined direction.

Figure 2A:
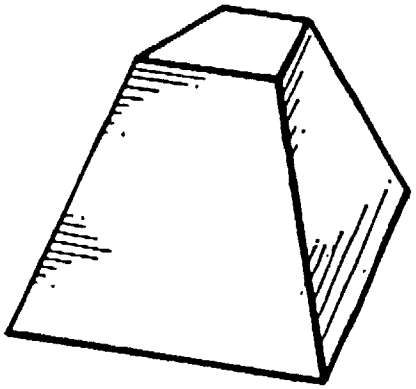
FIG. 2*a* is a perspective view showing a truncated trapezoidal pyramid shaped projection which may be used in the braking region and balance and acceleration region of the hard plate according to the present invention.

The projections 4 in the braking region (B) may be shaped in truncated trapezoidal pyramid (see FIG. 2*a*) or oblique pyramid. In such a case, side faces opposite to each other are orthogonal with the first inclined direction, and a width of a rear side face is smaller than that of a front side face.

Each of the projections 5 in the balance and acceleration region (C) may be shaped in truncated trapezoidal pyramid (see FIG. 2*a*) or oblique pyramid. In this case, side faces opposite to each other are orthogonal with the second inclined direction, and a width of a front side face is smaller than that of a rear side face.

Figure 3:
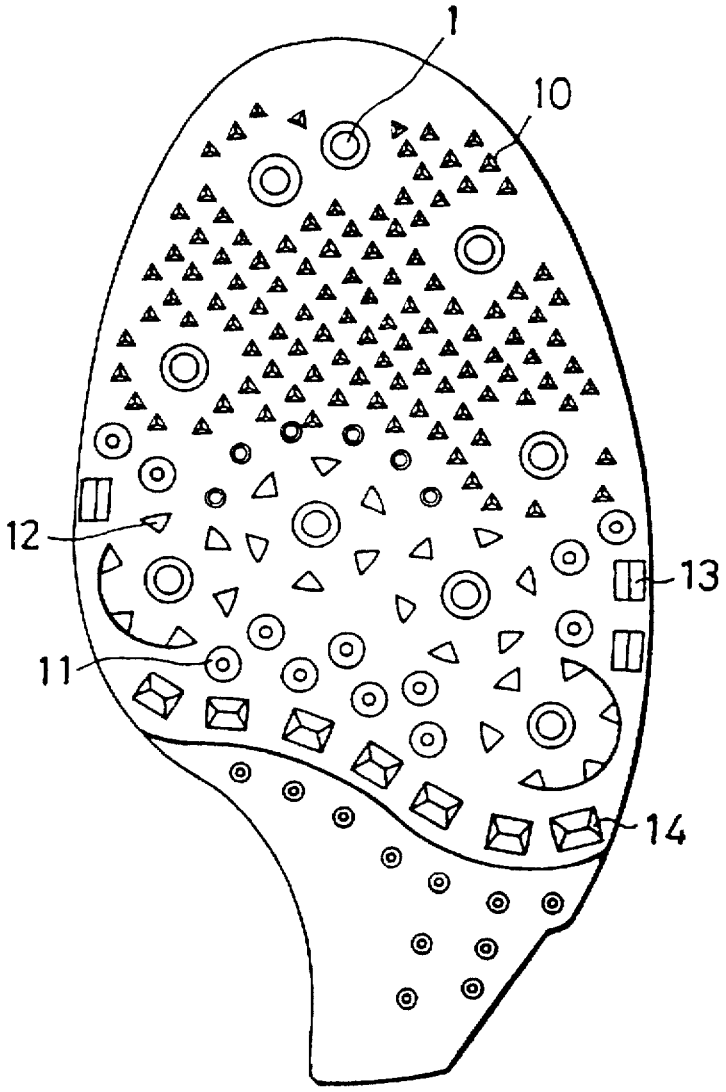
FIG. 3 is a plan view of a second embodiment of the present invention.

The present invention will be explained in detail on the basis of the second embodiment shown in FIG. 3.

A plurality of small projections 10 are arranged on the anterior forefoot portion in about half the forefoot portion. Each of the small projections 10 is a triangular pyramid. One of side faces of each of the small projections 10 is orthogonal with the center line 6 of the shoe and faces rearward. A ridge line opposite to the one of the side faces is oriented forwardly.

A plurality of projections 11 each in the shape of a truncated cone, a plurality of projections 12 each in the shape of a longitudinally placed triangular prism (i.e., a triangular prism mounted on its end face), and a plurality of projections 13 each in the shape of a laterally placed triangular prism (i.e., a triangular prism mounted on one of its bases) are arranged on the posterior forefoot portion in about half the forefoot portion. A series of prismatoids 14 each having generally rectangularly shaped base and opposed pairs of converging polygonal sides are also arranged on the posterior forefoot portion in general longitudinal alignment with the rearwardmost edge of the forefoot portion (i.e., are laterally placed). As shown in FIG. 3, the posterior forefoot portion may include a number of the spikes 1, with the projections 12 arranged in a circular formations therearound.

Figure 4:
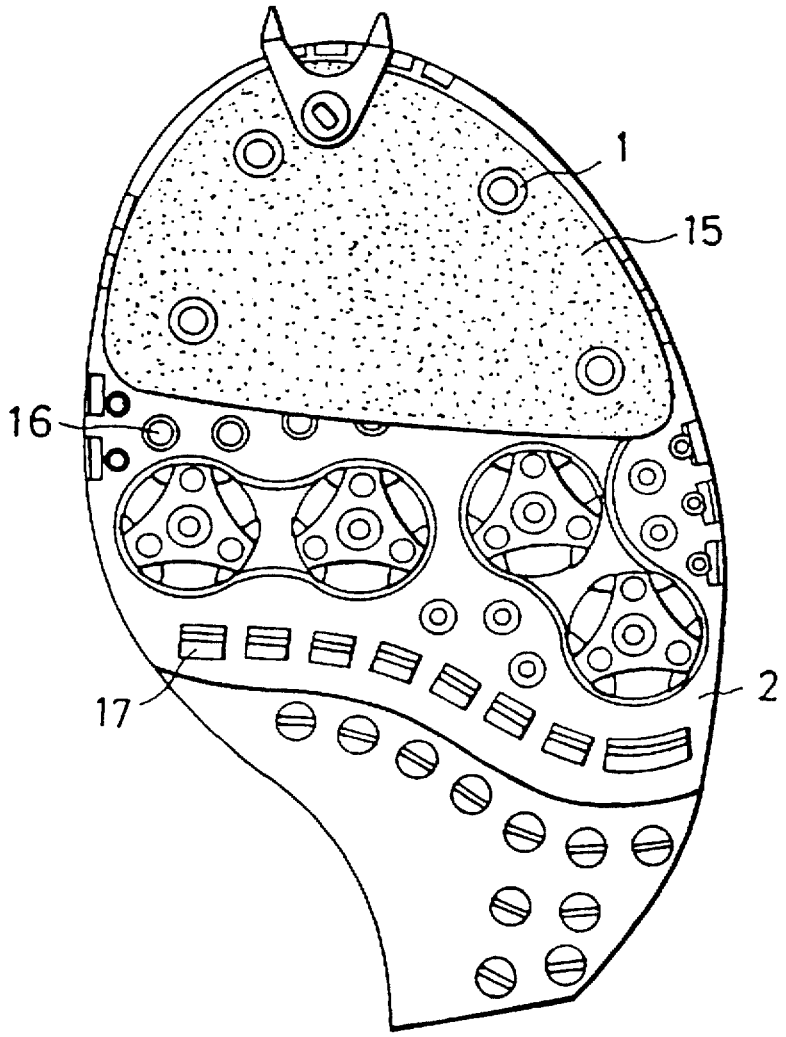
FIG. 4 is a plan view of a third embodiment of the present invention.

The present invention will be explained in detail on the basis of the third embodiment shown in FIG. 4.

A substantially trapezoidal sheet 15 made of hard fine particulate such as a sand paper is attached individually onto the anterior forefoot portion in about half the forefoot portion. The sheet 15 may be shaped in irregular cloud form. The sheet 15 is made of synthetic resin which is hard and has a good proof effect against the slip. The sheet 15 is attached onto the hard plate 2 by an adhesion or a gluing. A plurality of projections shaped in truncated cone 16 or laterally placed triangular prism 17 are arranged on the posterior forefoot portion in about half the forefoot portion.

Figure 6:
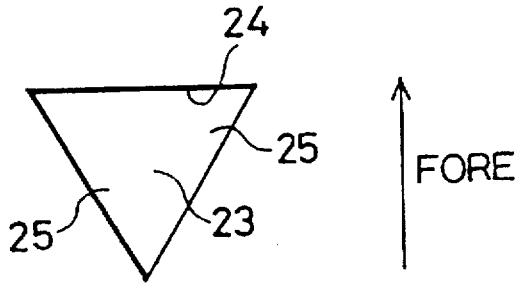
FIG. 6 is an explanatory view of one embodiment of a small hole.
Figure 7:
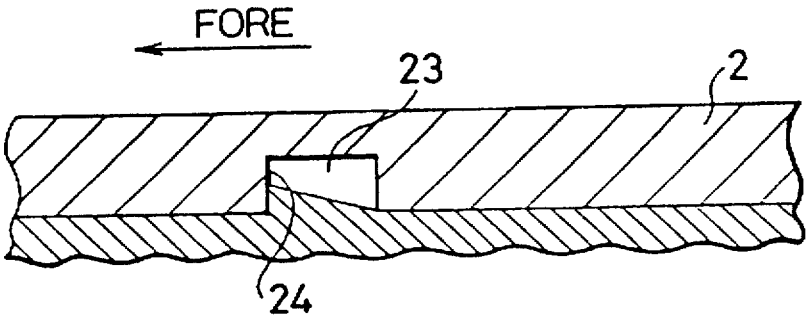
FIG. 7 is a longitudinally cross-sectional view of a hard plate for explaining a function of the small hole.

A first variation of the propulsion region (A) will be explained hereinafter with referring to FIGS. 5 to 7.

The forefoot portion is provided with a plurality of vertical small holes 23 on an anterior about half side thereof. Each of the small holes 23 is shaped preferably in a triangle. One side face 24 of each small hole 23 is perpendicular to the center line 6 of the shoe and is disposed in the front of each small hole 23. The other two faces 25 are oriented rearwardly. A length of the side face 24 is between 5 and 10 mm. A depth of each small hole 23 is not less than the half thickness of the hard plate 2, and the hard plate 2 may be penetrated through each small hole 23.

Since the side face 24 is vertical to a propelling direction, it displays the largest gripping force when the surface of the hard plate 2 touches the ground.

The variations of the small holes 23 will be explained with referring to FIG. 8*a* to FIG. 8*g*.

Figure 8A:
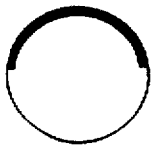
FIG. 8*a* to FIG. 8*g* are explanatory views of another embodiments of the small hole.
Figure 8B:
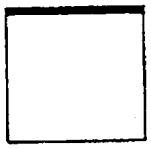
Figure 8C:
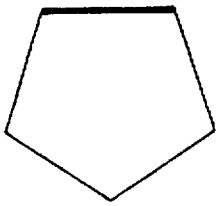
Figure 8D:
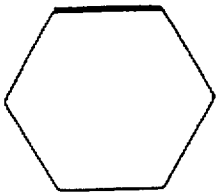
Figure 8E:
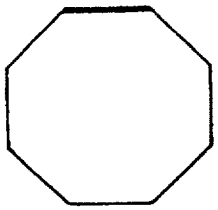
Figure 8F:
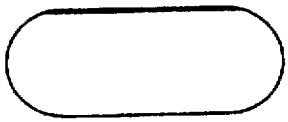
Figure 8G:
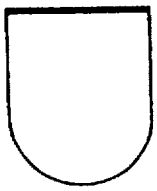

A shape of each small hole 23 may be a circle (FIG. 8*a*), a rectangle (FIG. 8*b*), a pentagon (FIG. 8*c*), a hexagon (FIG. 8*d*), an octagon (FIG. 8*e*), an ellipse (FIG. 8*f*), or a horseshoe-shape (FIG. 8*g*). However, whatever shape the small holes 23 have, the front side face 24 of each small hole 23 is arranged so as to be perpendicular to the center line 6 of the shoe, and the front side face 24 measures between 3 and 10 mm in length.

A shape in a longitudinal cross-section of each small hole 23 will be explained hereinafter with referring to FIG. 9*a* to FIG. 9*d*.

Figure 9A:
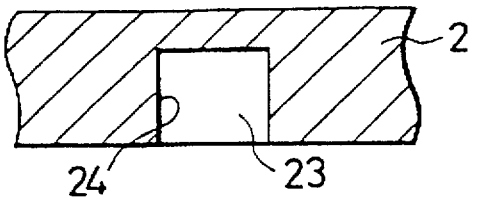
FIG. 9*a* to FIG. 9*d* are explanatory views of variations of a shape in a longitudinally cross-section of the small hole.
Figure 9B:
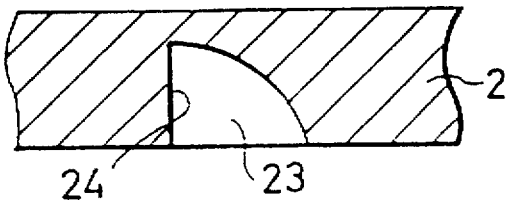
Figure 9C:
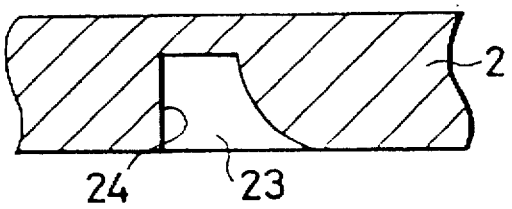
Figure 9D:
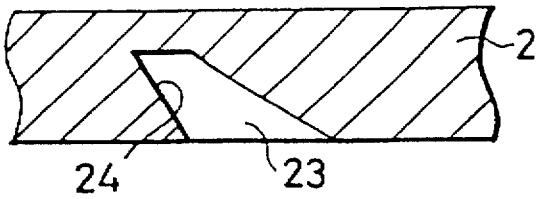

A front side face 24 of each small hole 23 is preferably vertical as shown in FIG. 9*a*. As shown in FIG. 9*b* and FIG. 9*c*, a rear side face may be inclined. Further, as shown in FIG. 9*d*, the front side face 24 and the rear side face may be both inclined.

Figure 10:
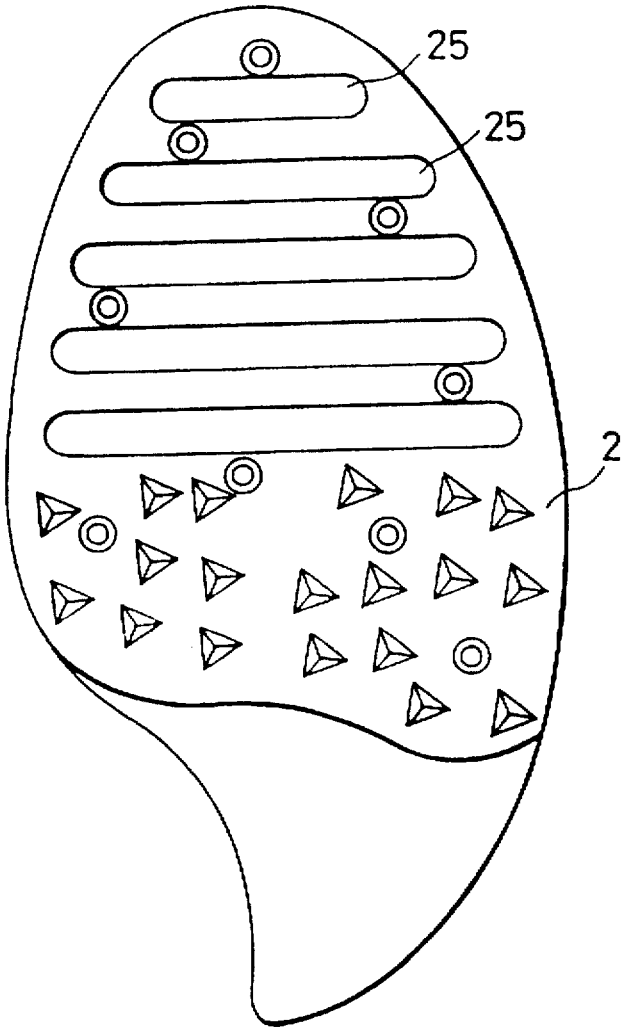
FIG. 10 is an explanatory view of a second variation of the propulsion region (A)

A second variation of the propulsion region (A) will be explained hereinafter with referring to FIG. 10.

The forefoot portion is provided with a plurality of transverse grooves 25 on an anterior about half side thereof. Each groove 25 extends perpendicularly to the center line 26 of the shoe. Each groove 25 has a width dimension of between 5 and 10 mm. The spacing between adjacent grooves 25 is between 1 and 5 mm. The depth and a shape in the longitudinal cross-section of each groove 25 are the same as those of the above-mentioned small hole 23.

Figure 11A:
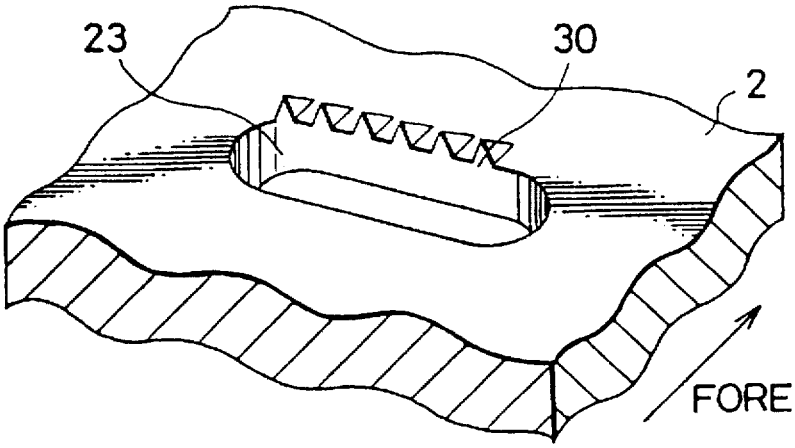
FIG. 11*a* and FIG. 11*b* are explanatory views of a third variation of the propulsion region (A)
Figure 11B:
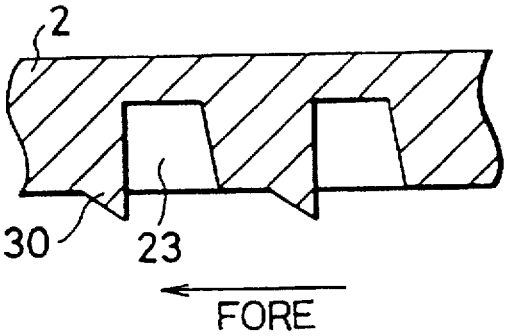

A third variation of the propulsion region (A) will be explained with referring to FIG. 11*a* and FIG. 11*b*.

Figure 5:
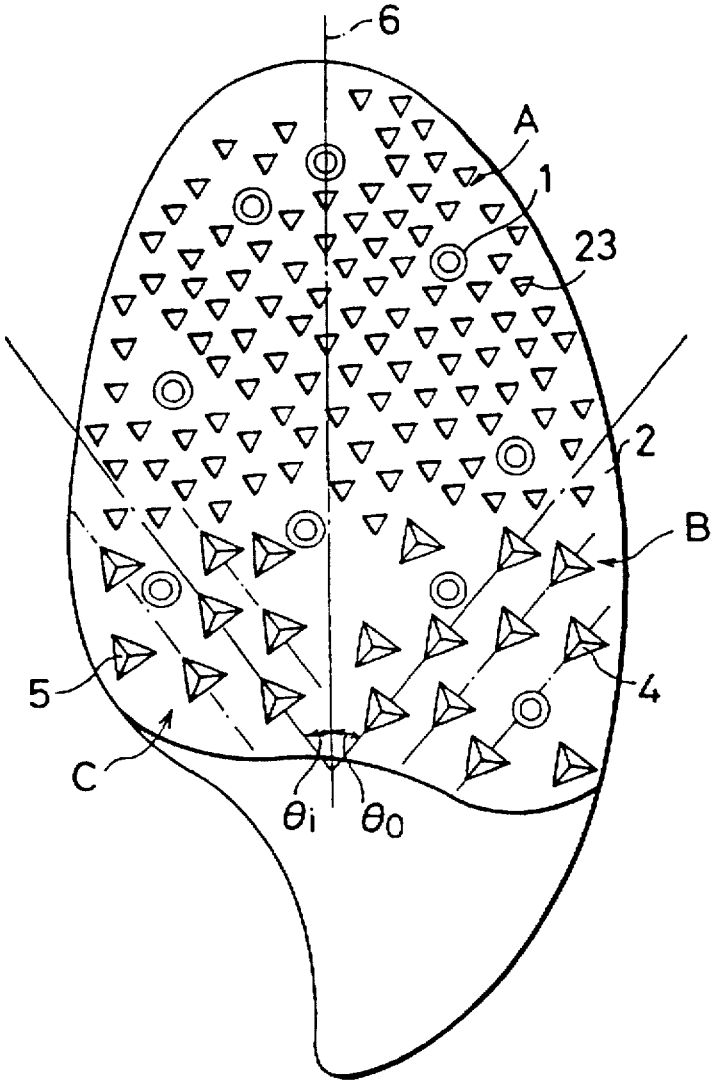
FIG. 5 is an explanatory view of a first variation of the propulsion region (A)

The forefoot portion is provided with a plurality of vertical small holes 23 on an anterior about half side thereof (FIG. 5). The small holes 23 each is shaped preferably in an ellipse. The front side face 24 of each hole 23 is provided in a sawtoothed manner with triangular pyramid-like protrusions 30 on an edge thereof (FIG. 11*a*). A height of each protrusions 30 is between 1 and 5 mm (FIG. 11*b*).

A fourth variation of the propulsion region (A) will be explained hereinafter with referring to FIG. 12*a* and FIG. 12*b*.

The forefoot portion is provided with a plurality of vertical small holes 23 on an anterior about half side thereof. A shape of each small hole 23 is preferably a circle. The hard plate 2 is not penetrated through the small hole 23, and a depth of each small hole 23 is preferably not less than the half of the thickness of the hard plate 2.

Figure 12A:
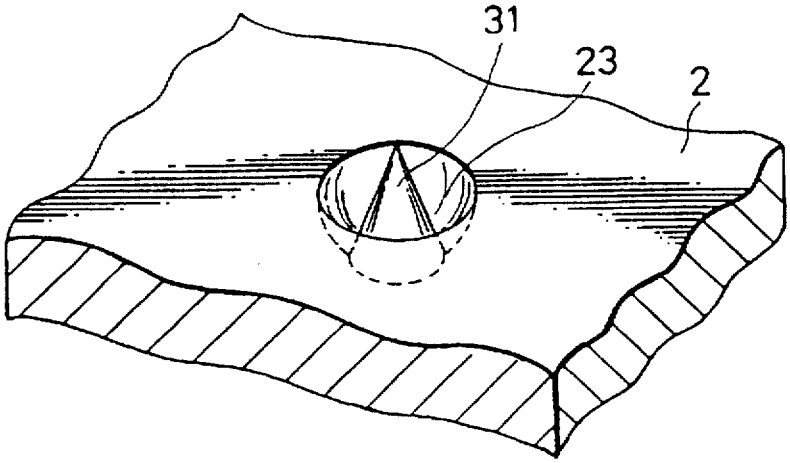
FIG. 12*a* and FIG. 12*b* are explanatory views of a fourth variation of the propulsion region (A)
Figure 12B:
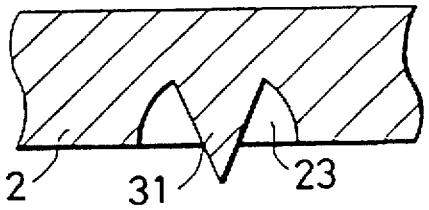

A cone-like protruding portion 31 protrudes from a bottom of each small holes 23 to exceed an edge of the small hole 23 by 1 to 5 mm (FIG. 12*a* and FIG. 12*b*).

Figure 13:
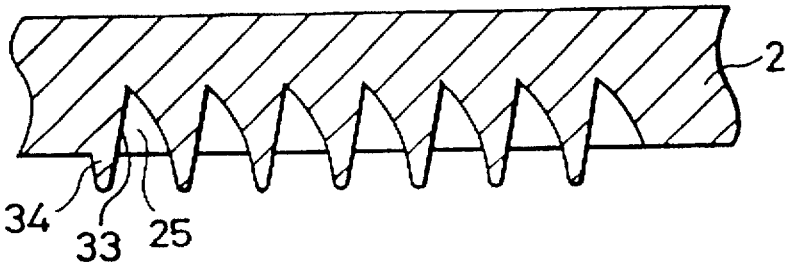
FIG. 13 is an explanatory view of a fifth variation of the propulsion region (A)

A fifth variation of the propulsion region (A) will be explained with referring to FIG. 13.

The forefoot portion is provided with a plurality of transverse grooves 25 on an anterior about half side thereof. Each groove 25 extends vertically to the center line 26 of the shoe. The front side face 33 of each groove 25 is provided with a ridge 34 (FIG. 13) on an edge thereof. The height of each ridge 34 is between 1 and 5 mm. A shape of each ridge 34 may be liner or may be sawtoothed in triangles.

Figure 14A:
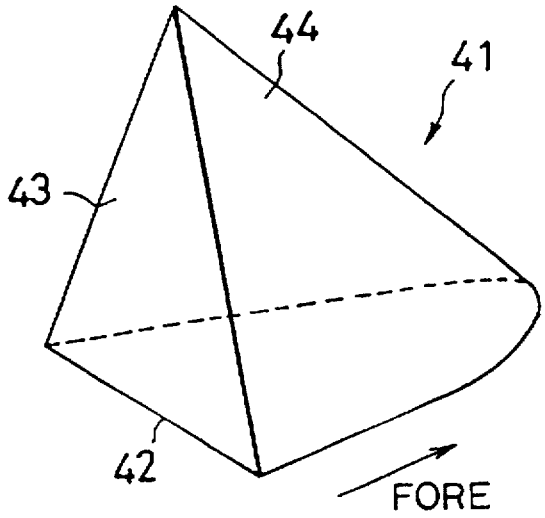
FIG. 14*a* and FIG. 14*b* are explanatory views of a variation of the projection 3.
Figure 14B:
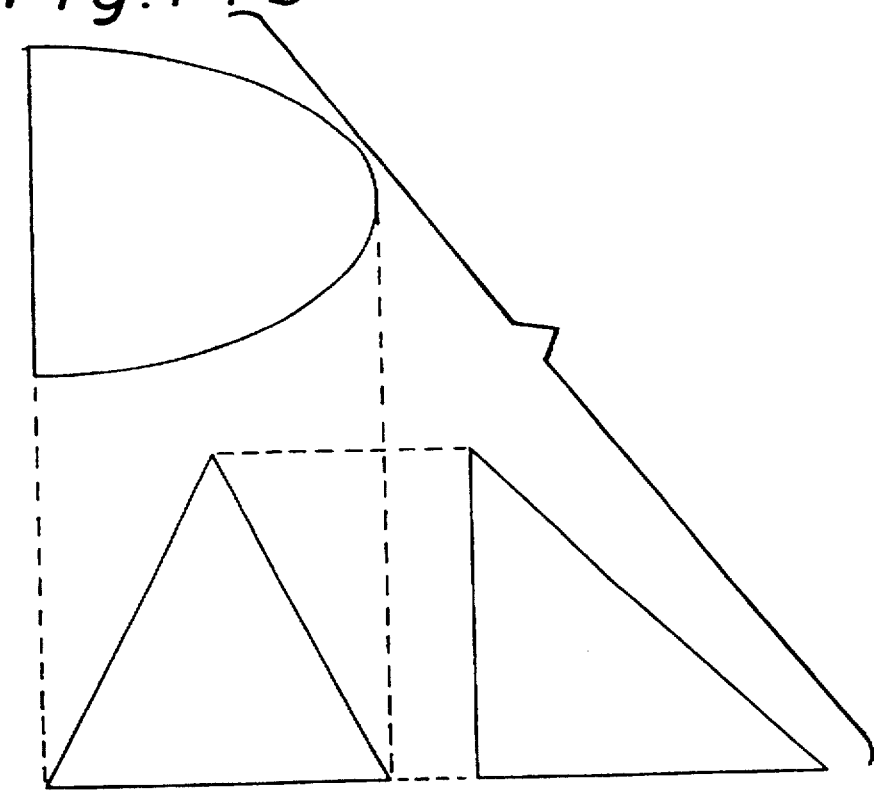

A variation of the small projection 3 in the first embodiment of the present invention shown in FIG. 1 and FIG. 2 will be explained hereinafter with referring to FIG. 14. FIG. 14*a* is a perspective view of the above mentioned variation, and FIG. 14*b* is three side view of the above mentioned variation.

The projection 41 is a substantially semi-elliptical cone, a bottom face shape of the semi-elliptical cone being a semi-ellipse cut at a minor axis 42 thereof. One side face 43 including the minor axis 42 is orthogonal with the center line 6 of the shoe and faces rearward.

In the most preferable embodiment of the projection 41, a rear side face 43 is preferably vertical to a bottom of the hard plate 2, and a height of the projection 41 is between 2 and 6 mm, preferably between 4 and 5 mm, a longitudinal length of a bottom face of the projection 41 is between 2 and 7 mm, preferably between 3 and 5 mm, and a lateral length of the bottom face thereof is between 2 and 7 mm, preferably between 3 and 5 mm.

A bottom face shape of the projection 41 may be a semi-ellipse cut at a major axis thereof, or may be a semi-circle.

The function to be fulfilled by the small projection provided in the propulsion region (A) is to produce an utmost propulsion force to the ground (the gripping force with the ground and the repulsion force). In other words, the function resides in depressing maximally an energy loss caused by gripping with the ground of the forefoot portion during a running movement from landing on the ground to kicking against the ground, and in promoting a kicking power by transmitting efficiently the repulsion force from the ground to the foot of the runner wearing the spike shoes. Especially in a short distance track race competing in 0.01 second, it is important how to make the projections efficiently function from landing on the ground to kicking against the ground. Therefore, in order to produce an utmost propulsion force in the forefoot portion during the moment from touching the ground to tacking off the ground, the small projection is desired to have such a shape as to produce maximally both the gripping force with the ground and the repulsion force.

However, the small projection 3 has three side faces which are all plane. Therefore, the gripping property to the ground is excellent, but the repulsion property is not so remarkably good.

However, comparing with the triangular pyramid-like projection 3, in the semi-elliptical cone projection 41, an inclined side face 44 can push and spread a pavement material while the top end of the projection plunges deeply into the pavement material of the track, and when a rearward and horizontal force is applied to the projection by a kick of the runner, a vertical side face 43 pushes horizontally the ground to produce fully the griping force, thereby minimizing the energy loss at a kick moment. Further, when the hard plate takes off the ground, a reversion force of the pavement material pushed and spread by the inclined side face 44 causes a grater repulsion force to be transmitted to the foot of the runner.

According to comparison data between the projection 41 and the projection 3 obtained by measurement in an experimental device setting a model of a first-rank short distance runner, the project.on 41 is improved by 2.8% in the repulsion property than the projection 3, while the gripping property is the same therebetween. Therefore, The projection 41 has a remarkably high practical value for use in a propulsion region of the hard plate for the track race spike shoes.

A variation of the large projection 4 in the first embodiment of the present invention shown in FIG. 1 and FIG. 2 will be explained hereinafter.

This variation is a substantially semi-elliptical cone which is approximately identical in shape with the small projection 41 as shown in FIG. 14*a*, a bottom face shape of the semi-elliptical cone being a semi-ellipse cut at the minor axis 42 thereof. An arrangement of the projections on the hard plate is the same as that of the projections 4.

A variation of the large projection 5 in the first embodiment of the present invention shown in FIG. 1 and FIG. 2 will be explained hereinafter.

This variation is a substantially semi-elliptical cone which is approximately identical in shape with the small projection 41 as shown in FIG. 14*a*, a bottom face shape of the semi-elliptical cone being a semi-ellipse cut at the minor axis 42 thereof. An arrangement of the projections on the hard plate 2 is the same as that of the projections 4.

Figure 15A:
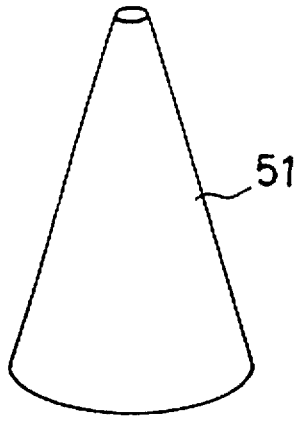
FIG. 15*a* to FIG. 15*c* are explanatory views illustrating three types of projections used in an experiment relating to a gripping property.

The most suitable combination of a shape and a density of the projections in the propulsion region of the hard plate of spike shoes for track races will be explained hereinafter with referring to FIG. 15 and FIG. 16.

Experimental Test

Figure 15B:
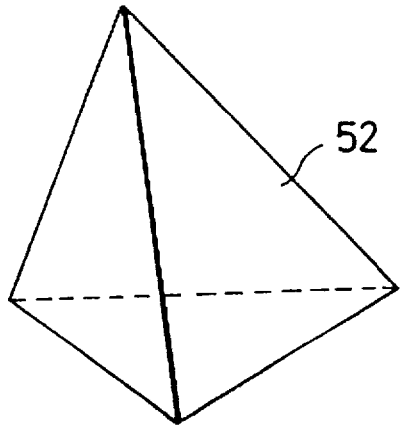
Figure 15C:
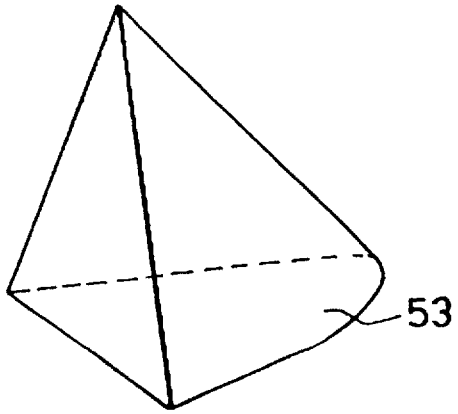

Three types of projections to be compared with each other are as follows, i.e. Type 1: a cone-like projection (Refer to FIG. 15*a*), Type 2: a triangular pyramid-like projection (Corresponding to the projection 3. Refer to FIG. 15*b*), and Type 3: semi-elliptical cone-like projection (Corresponding to the projection 41. Refer to FIG. 15*c*).

Figure 16:
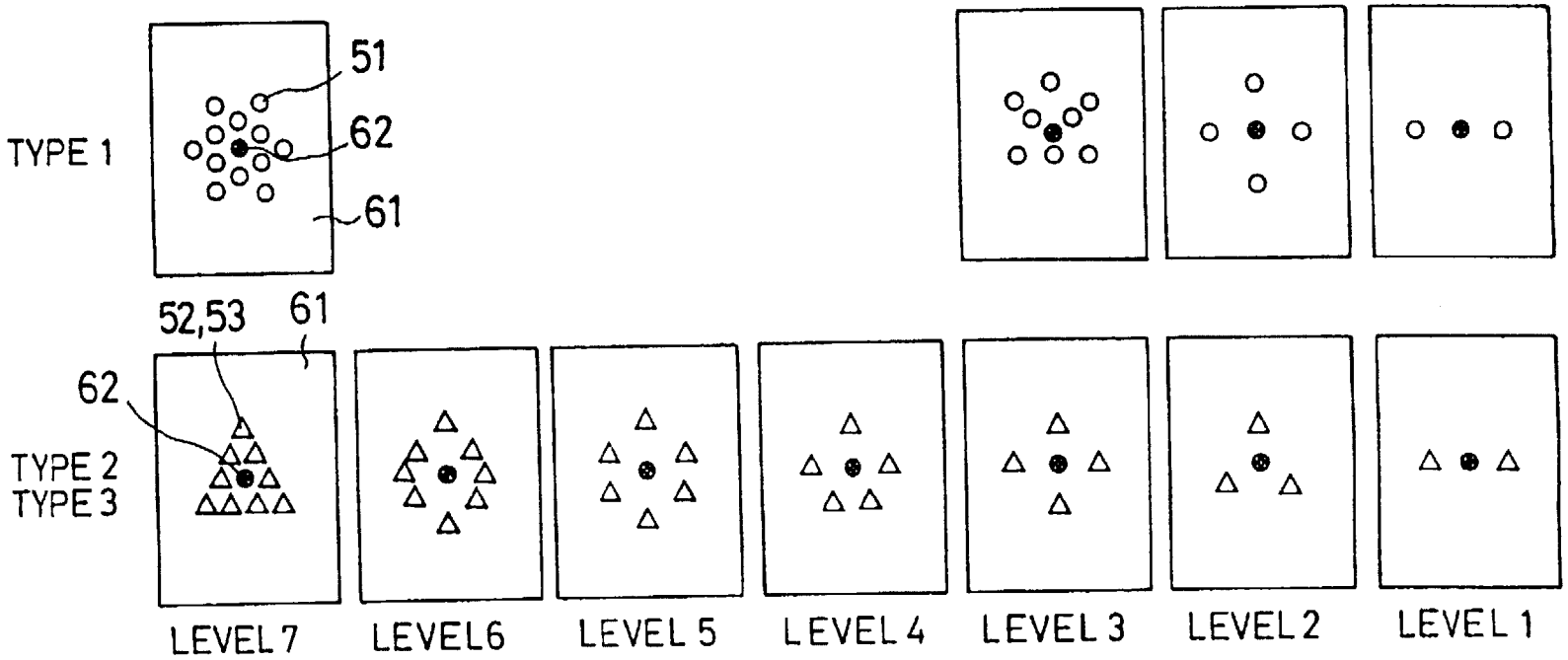
FIG. 16 is an explanatory view illustrating density variations of three types of projections used in an experiment relating to a gripping property.

As shown in FIG. 16, the density of the projections has four variations of Levels 1 to 3 and 7 for Type 1, seven variations of Levels 1 to 7 for Types 2 and 3 respectively. All of the test plates 61 for respective types of projections, each is provided with a spike of 9 mm in length and of 2 mm in diameter at a center thereof, the spike having a great gripping force with the ground, and is provided with the projections 51, 52 or 53 around the spike.

Supposing that the parameters of the densities of projections for the respective levels are defined as D1=total projection bottom face area/propulsion region area×100(%), and D2=the number of projections/propulsion region area (pieces/cm$^2$). The experimental tests are carried out for respective following combinations. The projection of Type 1 is 7 mm in height and 6 mm in a diameter of the bottom face. The protection of Type 2 is 7 mm in height and 7 mm in a longitudinal length of a bottom face, and 7 mm in a lateral length of the bottom face. The projection of Type 3 is 7 mm in height and 7 mm in a longitudinal length of a bottom face, and 7 mm in a lateral length of the bottom face.

TABLE 1

| Projection shape | Level | D1 (%) | D2 (pieces/cm$^2$) |
|---|---|---|---|
| Type 1 | Level 1 | 6.3 | 0.22 |
| | 2 | 12.6 | 0.44 |
| | 3 | 25.1 | 0.89 |
| | 7 | 37.7 | 1.33 |
| Type 2 | 1 | 5.4 | 0.22 |
| | 2 | 8.2 | 0.33 |
| | 3 | 10.9 | 0.44 |
| | 4 | 13.6 | 0.56 |
| | 5 | 16.3 | 0.67 |
| | 6 | 21.8 | 0.89 |
| | 7 | 24.5 | 1.00 |
| Type 3 | 1 | 8.6 | 0.22 |
| | 2 | 12.8 | 0.33 |
| | 3 | 17.1 | 0.44 |
| | 4 | 21.4 | 0.56 |
| | 5 | 25.6 | 0.67 |
| | 6 | 34.2 | 0.89 |
| | 7 | 38.5 | 1.00 |

Results a) In a case where the pavement material is "Tartan"

Test plates are prepared for every type of projection in a density on respective four levels of Levels 1 to 3 and 7, and the experimental tests are carried out on "Tartan", 40 tries of test are performed for every kind of test plates to obtain data. The gripping properties are compared with each other based on the average value of 40 data on every kind of test plates. According to the previously conducted comparison experimental test of the gripping force, it has been found that a tendency of data is stabilized by repeating tests at over 30 tries under the above mentioned setting of the experimental test, so that 40 tries is found to be a reasonable number of tries.

Figure 17:
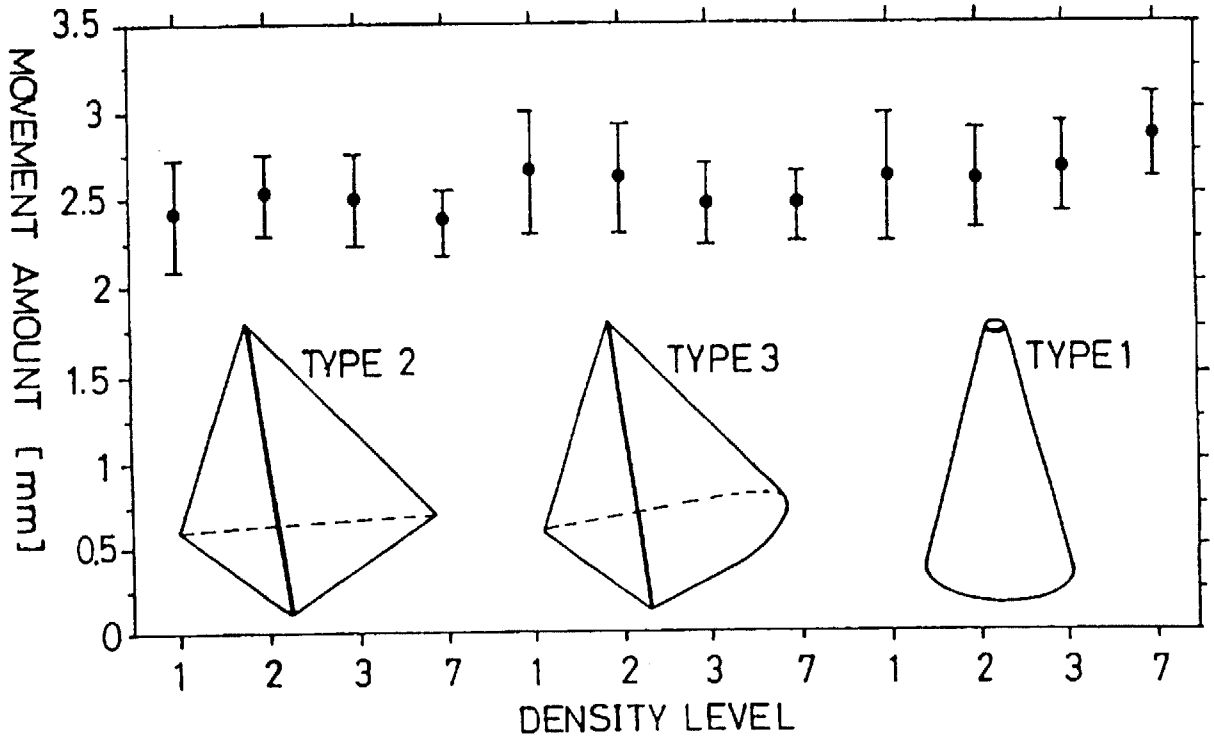
FIG. 17 is a graph showing an experiment result relating a gripping property in a case where a pavement material is "Tartan"

The results of experimental tests are shown in FIG. 17. The graph of FIG. 17 shows that the smaller the movement amount is, the greater the gripping force is. FIG. 17 shows that the projection of Type 1 is generally low in gripping property, as compared with the projections of other two types.

Next, according to the above mentioned same method, 40 tries of experimental test are performed for each of Types 2 and 3 of projection in a density on each of Levels 1 to 7 to obtain data. Types 2 and 3 are relatively great in a gripping force.

Figure 18:
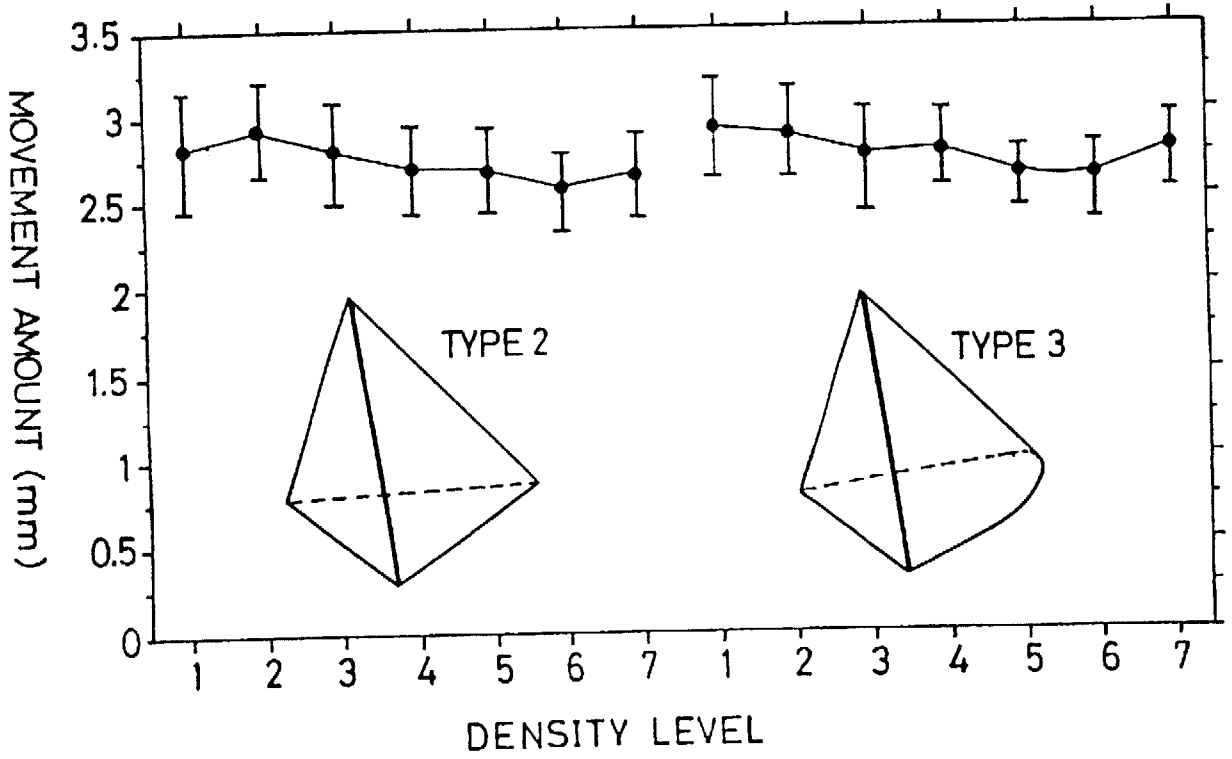
FIG. 18 is a graph showing an experiment result relating a gripping property in a case where a pavement material is "Tartan"

The results of experimental tests are shown in FIG. 18. The projections of either types have such a tendency that the greater the density of projections becomes, the greater the gripping force is, and that the gripping force becomes low again, when the density of projections exceeds Level 6.

The significant difference at 5% level exists only between Level 2 and Level 6 for Type 2, and between Levels 1, 2 and Level 6 for Type 3.

b) In a case where the pavement material is "Super X"

By using 18 kinds of test plates of Types 2 and 3 in a projection density on 7 levels, and of Type 1 in a projection density on 4 levels, the experimental tests are carried out based on the above mentioned same method while changing the pavement material to "Super X". Although, 40 tries of experimental test are performed for each of Types 2 and 3 of projection to obtain data, only 30 tries are performed for Type 1 for some experimental reasons. But, there are no problems in comparison data, because 30 tries are the necessary and sufficient try number as mentioned above.

Figure 19:
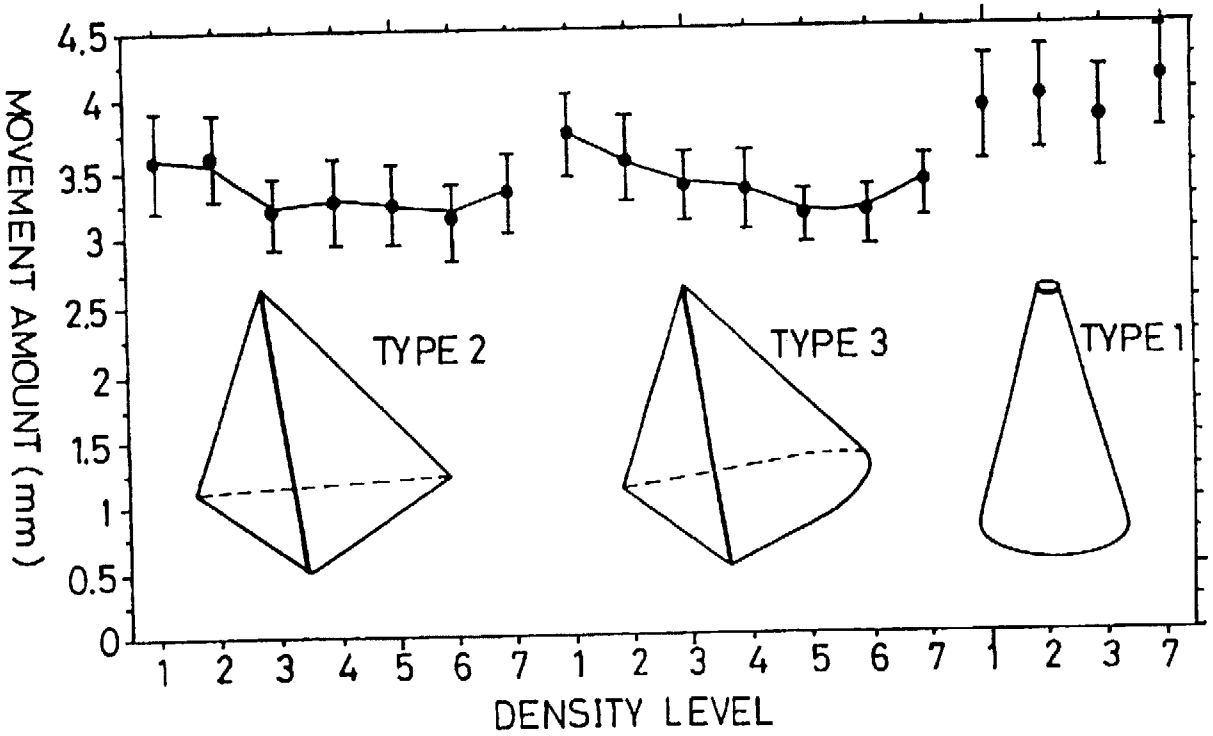
FIG. 19 is a graph showing an experiment result relating a gripping property in a case where a pavement material is "Super X"

The results of experimental tests are shown in FIG. 19. They are substantially the same as those in the case of "Tartan". In FIG. 19, the projection of Type 1 is low in gripping property all over the levels of density as compared with the projections of other two types, and the projections of Types 2 and 3 have such a tendency that the greater the density of projections becomes, the greater the gripping property is, and that the gripping property becomes low again, when the density of projections exceeds Level 6.

The significant difference at 9% level exists between Levels 1, 2 and Levels 3, 4, 5, 6 for Type 2, and exists between Level 1 and Levels 3, 4, 5, 6, 7 and between Level 2 and Levels 5, 6 for Type 3.

Figure 20:
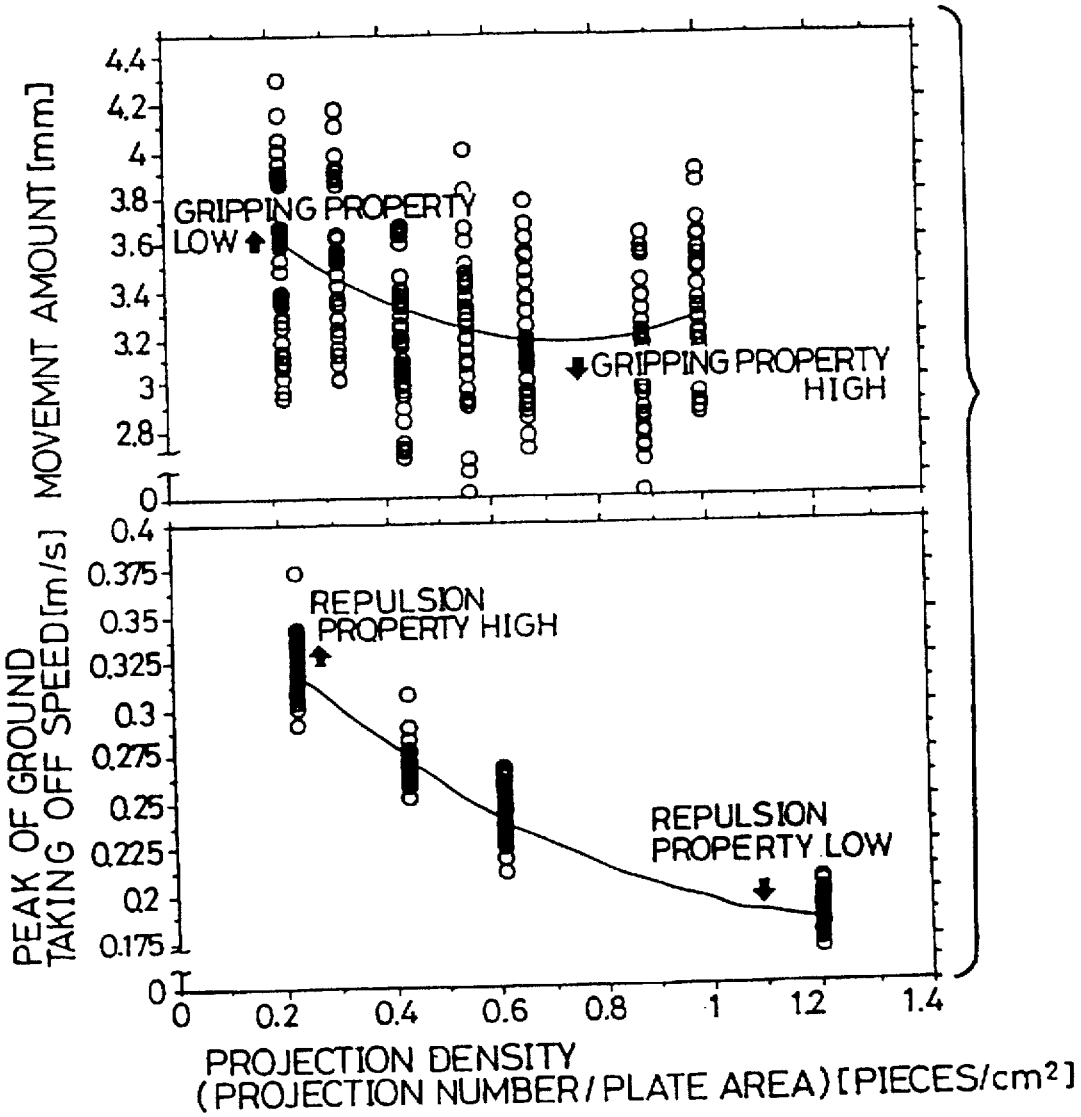
FIG. 20 is a graph showing a relation between a density of projections and a gripping property, a repulsion property of Type 2 for "Super X"
Figure 21:
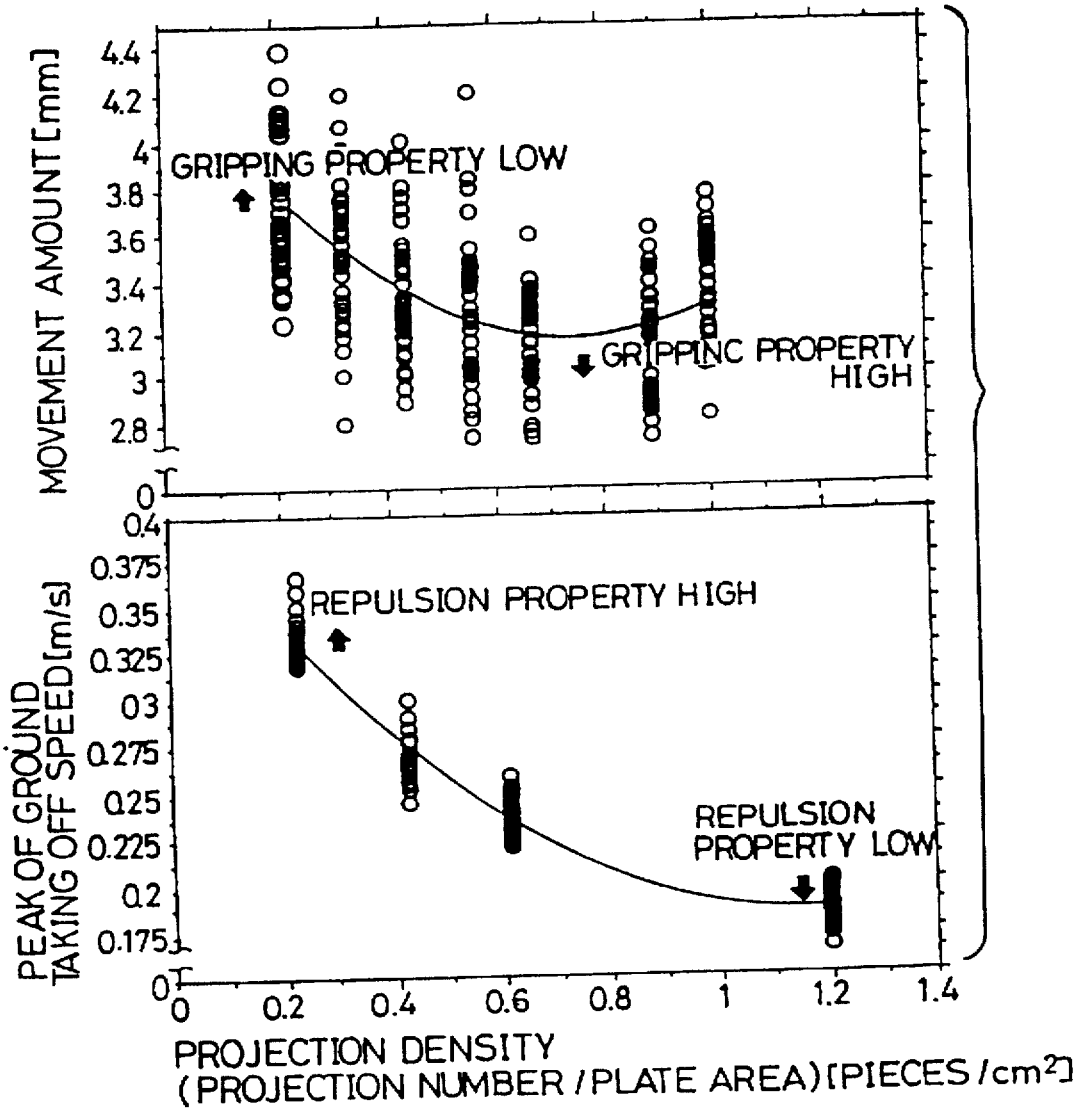
FIG. 21 is a graph showing a relation between a density of projections and a gripping property, a repulsion property of Type 3 for "Super X".

A relation between a projection density (converted into the number of projections to 1 $cm^3$), and a gripping property and a repulsion property of Type 2 or 3 on "Super X" is shown in FIG. 20 and FIG. 21. FIG. 20 corresponds to Type 2, and FIG. 21 corresponds to Type 3. In these Figures, a circle designates a plotted point for each try, and a curve is a secondary regression curve. Although the dispersion of data on the gripping property seems to be great for some graphical expression reasons, a variation coefficient is between 6 to 13%. The data on the repulsion property which was obtained in another measurement experimental test is used.

As clarified by Figures, tendencies of curves do not differ especially from each other depending on the shape of the type of projection. The gripping property and the repulsion property have a completely contrast tendency to that of the density of projections.

Both of the gripping property and the repulsion property for the projections of Type 2 and 3 are low in a case where the density of projections is below 0.4 (pieces/$cm^2$) or above 0.8 (pieces/$cm^2$).

When a unit of the density of projections (pieces/$cm^2$) is converted to a unit of the density of projections (total projection bottom face area/plate are×100%) the density of projections is 9.8 to 19.6 for type 2, and is 15.4 to 30.8 for Type 3.

Accordingly, in order to maintain both of the gripping property and the repulsion property adequately great, the density of projections (total projection bottom face area/plate area×100%) is 9.8 to 30.8, preferably 15.4 to 19.6.

Many widely different embodiments of the present invention may, be constructed without departing from the spirit and scope of the present invention, it should be understood that the present invention is not limited to the specific embodiments described in the specification, except as defined in the appended claims.

What is claimed is:

1. A hard plate for a spiked track shoe comprising:

a propulsion region for gripping ground surface and suppressing rearward slippage of the track shoe relative to the ground surface, said propulsion region being provided with a plurality of transverse grooves extending perpendicularly relative to a center line of said shoe on a substantially overall anterior forefoot portion in at least about one-half a forefoot portion;

a braking region for buffering landing impact on the ground surface and for rapidly gripping the ground surface upon landing, said braking region being provided with a plurality of first large projections having a pyramid shape on an outer side of a posterior forefoot portion, said first large projections are aligned outwardly from the center line of said shoe in a first inclined direction at a first predetermined angle, wherein a base of one side face of each of said first large projections is orthogonal with said first inclined direction, and wherein said one side face of each of said first large projections is oriented substantially forwardly in said first inclined direction; and a balance and acceleration region for maintaining right and left balances on contact with the ground surface and for providing a propulsion force at a start dash moment, said balance and acceleration region being provided with a plurality of second large projections having a pyramid shape on an inner side of said posterior forefoot portion, wherein said second large projections are aligned inwardly from said center line of said shoe in a second inclined direction at a second predetermined angle, and wherein a base of one side face of each of said second large projections is orthogonal with said second inclined direction, and wherein said one side face of said second large projection is oriented substantially rearwardly in said second inclined direction.

2. A hard plate according to claim 1, wherein each of said transverse grooves has a width dimension of between 5 and 10 mm.

3. A hard plate according to claim 1, wherein spacing between adjacent ones of said transverse grooves is between 1 mm and 5 mm.

4. A hard plate according to claim 1, wherein each of said transverse grooves has a vertical front side face.

5. A hard plate according to claim 4, wherein each of said transverse grooves has an inclined rear side face.

6. A hard plate according to claim 1, wherein each of said transverse grooves have inclined front side and rear side faces.

7. A hard plate according to claim 1, wherein each of said grooves is provided with a ridge on a front face thereof.

8. A hard plate according to claim 7, wherein said ridge has a height of between 1 and 5 mm.

9. A hard plate according to claim 7, wherein said ridge has a linear shape.

10. A hard palate according to claim 7, wherein said ridge has a saw-toothed triangle shape.

11. A hard plate according to claim 1, wherein both of said first large projections and second large projections are triangular pyramids.

12. A bard plate according to claim 1, wherein said both of said first large projections and second large projections are substantially semi-cones, a bottom face shape of which being a semi-ellipse cut at a central symmetric axis thereof.

13. A hard plate according to claim 1, wherein said both of said first large projections and second large projections are truncated trapezoidal pyramids, side faces opposite each other are orthogonal with one of said first inclined direction and said second inclined direction, a width of a rear side face is smaller than a front side face in said first large projections, a width of a front side face in smaller than a rear side face in said second large projections.

14. A hard plate according to claim 1, wherein said both of said first large projections and second large projections are oblique pyramids, side faces opposite each other are orthogonal with one of said first inclined direction and said second inclined direction, a width of a rear side face is smaller than a front side face in said first large projections, a width of a front side face is smaller than a rear side face in said second large projections.

15. A hard plate according to claim 1, wherein at least one of said first predetermined angle and said second predetermined angle is in the range of 5° to 45°.

16. A hard plate according to claim 1, wherein at least one of said first predetermined angle and said second predetermined angle is 14°.

* * * * *